US005605228A

United States Patent [19]

Baxter

[11] Patent Number: 5,605,228

[45] Date of Patent: Feb. 25, 1997

[54] KEEL FOR WRAPAROUND ARTICLE CARRIER

[75] Inventor: Ronald A. Baxter, Douglasville, Ga.

[73] Assignee: The Mead Corporation, Dayton, Ohio

[21] Appl. No.: 465,852

[22] Filed: Jun. 6, 1995

[51] Int. Cl.[6] ..... B65D 65/00

[52] U.S. Cl. ..... 206/427; 206/434; 206/140

[58] Field of Search ..... 206/140, 155, 206/157, 160, 194, 196, 427, 434

[56] References Cited

U.S. PATENT DOCUMENTS

| | | | |
|---|---|---|---|
| 3,381,881 | 5/1968 | Ganz et al. | 206/140 |
| 3,498,449 | 3/1970 | Spery | 206/434 |
| 4,489,880 | 12/1984 | Calvert | 206/434 |
| 4,574,997 | 3/1986 | Ikeda | 206/194 |
| 4,703,847 | 11/1987 | Oliff | 206/140 |
| 5,402,888 | 4/1995 | Marie | 206/426 |
| 5,437,363 | 8/1995 | Gungner | 206/140 |

FOREIGN PATENT DOCUMENTS

| | | |
|---|---|---|
| 0461947A1 | 12/1991 | European Pat. Off. . |
| WO94/12403 | 6/1994 | WIPO . |

*Primary Examiner*—David T. Fidei
*Attorney, Agent, or Firm*—Michael V. Drew

[57] ABSTRACT

A keel structure in a wraparound type article carrier (10) has at least one trapezoidal-shaped keel element (40) formed from a pair of opposing upstanding panels (32, 42) which are spaced apart and interconnected at uneven heights by a platform (44) which has curved edges (47, 43) extending toward one another. At least one stabilizing tab (48) is interconnected with at least one of the upstanding panels (32, 42) and disposed in face contacting relationship with a base (20) of the article carrier (10).

9 Claims, 2 Drawing Sheets

KEEL FOR WRAPAROUND ARTICLE CARRIER

TECHNICAL FIELD OF THE INVENTION

The invention relates generally to wraparound type article carriers, and more particularly to an impact-resistant keel structure for a wraparound type article carrier.

BACKGROUND

Wraparound type article carriers with keels are disclosed in U.S. Pat. No. 4,574,997 to Ikeda, U.S. Pat. No. 4,703,847 to Oliff, U.S. Pat. No. 5,402,888 to Marie, European Patent Office application publication number 0 461 947 A1 for Compagnie Gervais Danone for the invention of Georgeault, and international application number WO 94/12403 published under the Patent Cooperation Treaty for The Mead Corporation for the invention of Bakx.

SUMMARY OF THE INVENTION

In a preferred embodiment of the invention a keel structure in a wraparound type article carrier has at least one trapezoidal-shaped keel element formed from a pair of opposing upstanding panels which are spaced apart and interconnected at uneven heights by a platform which has curved edges extending toward one another. At least one stabilizing tab is interconnected with at least one of the upstanding panels and disposed in face contacting relationship with a base of the article carrier.

The present invention provides a keel structure that offers resistance to impacts received by a package made from the carton which impact might otherwise cause the keel to collapse. Other advantages and objects of the present invention will be apparent from the following description, the accompanying drawings, and the appended claims.

DETAILED DESCRIPTION OF THE PREFERRED EMBODIMENT

Figures 1, 2:
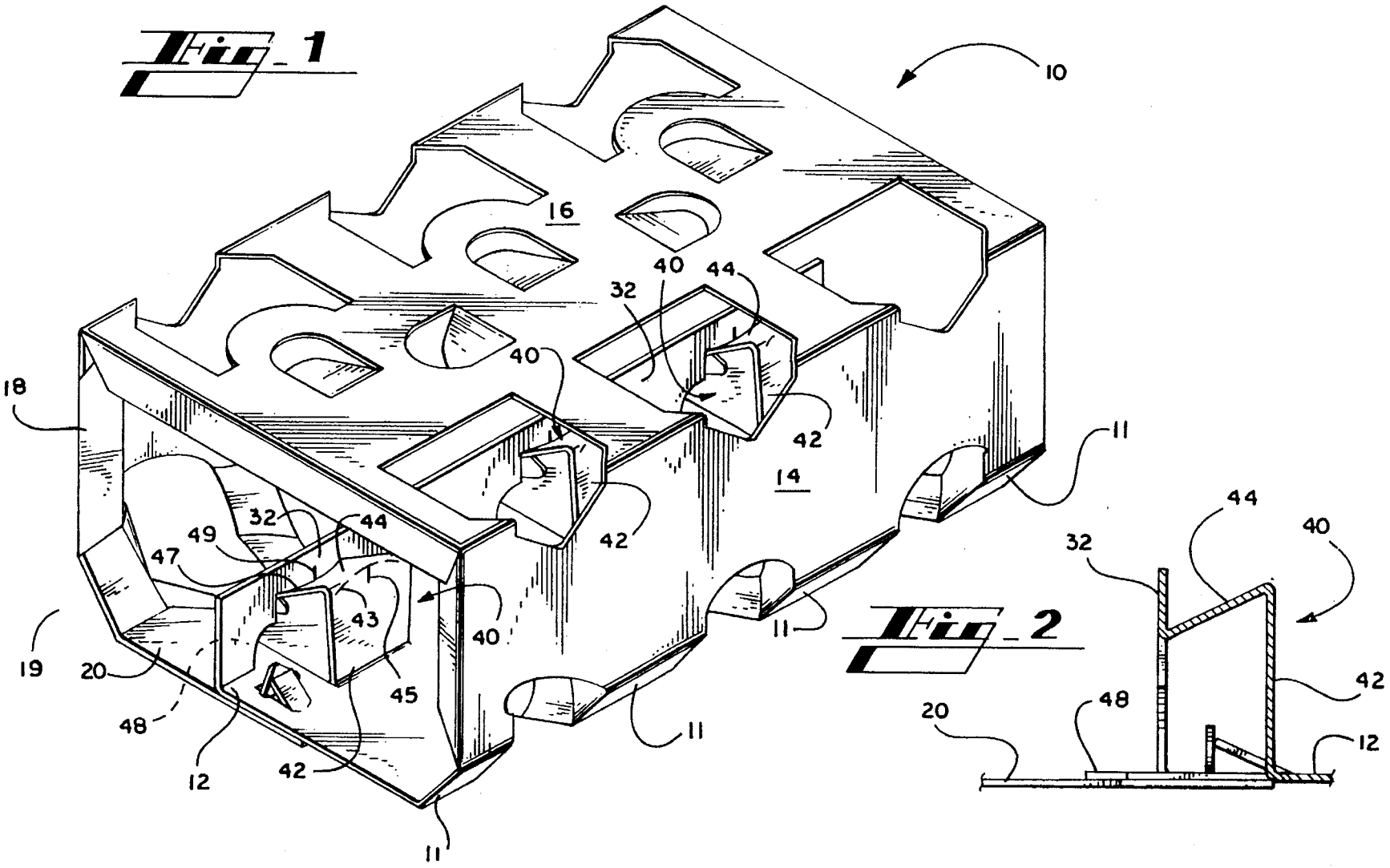
FIG. 1 is an isometric illustration of a wraparound type article carrier having a keel structure according to a preferred embodiment of the present invention.
FIG. 2 is a sectional illustration of the keel structure of the article carrier of FIG. 1.

The features of the invention will be explained in greater detail through the following description of a preferred embodiment of the invention. In the various views of the figures used and referred to to illustrate the preferred embodiment of the invention the same reference numerals are used to refer to like features.

Figure 3:
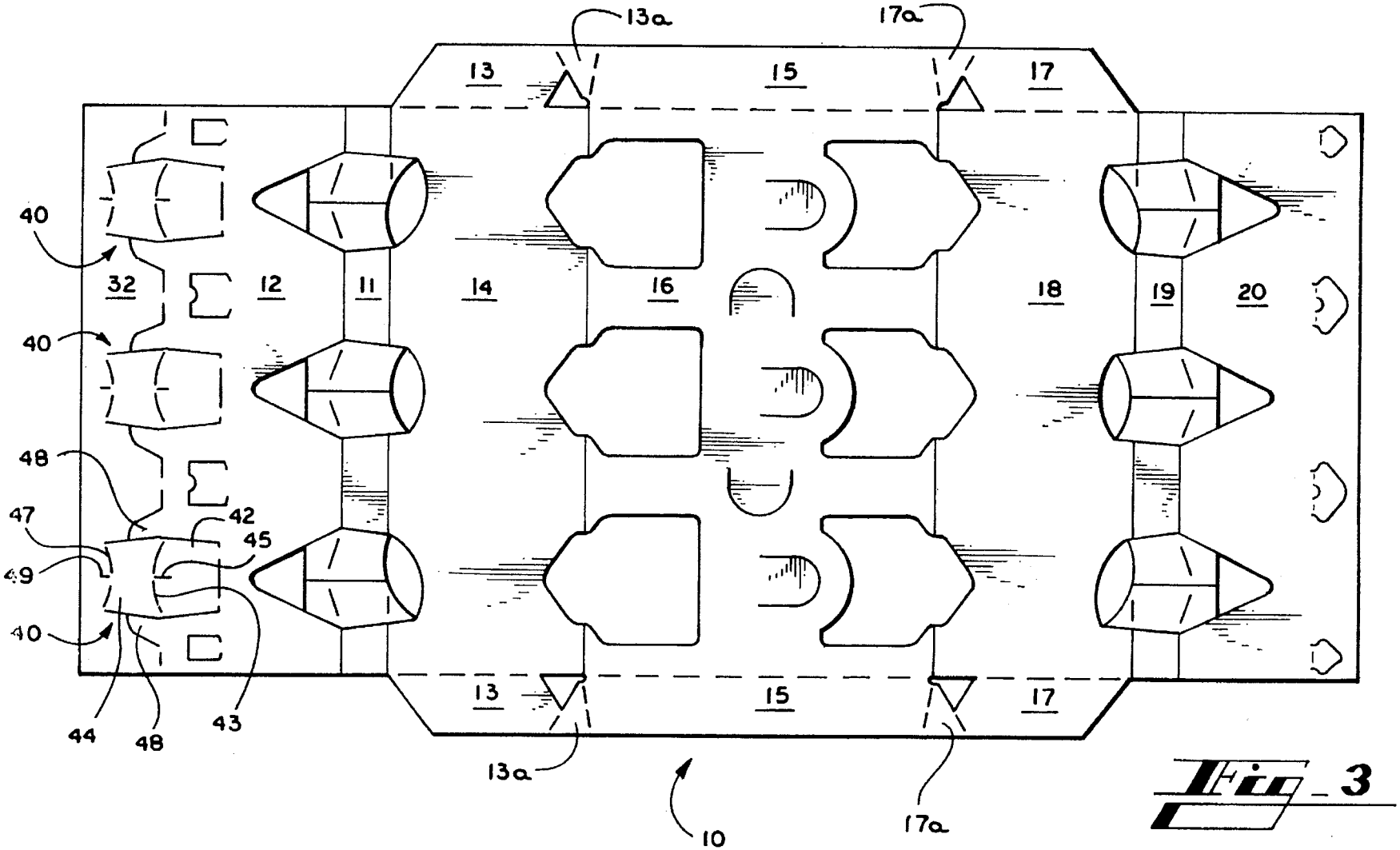
FIG. 3 is a plan illustration of blank for forming the article carrier of FIG. 1.

Referring first primarily to FIG. 1 but also generally to FIGS. 2 and 3, there is illustrated an erected wraparound type article carrier 10 having a keel structure according to a preferred embodiment of the invention. The article carrier 10 is of the wraparound type having foldably interconnected panels, namely, inner bottom 12, edge 11, side 14, top 16, side 18, edge 19, and outer bottom 20 panels. The carrier 10 illustrated also has end retention-display panels 15 which are connected to the top panel 16 and connected to the side panels 14, 18 by interconnecting webs 13, 13*a*, 17, 17*a*. The impact-resistant keel structure has trapezoidal keel elements

40 each of which is formed in the erected carrier 10 by a pair of upstanding panels 32 and 42. In the preferred embodiment illustrated one of the upstanding panels is a continuous panel 32 which extends between adjacent keel elements 40 and forms a flap foldably connected at the outer edge of the inner bottom panel 12. A platform 44 spaces apart and interconnects the panels 32, 42. The keel element 40 is given its generally trapezoidal configuration (shown clearly in FIG. 2) by connection of the platform 44 to one of the upstanding panels 42 at a greater height above the base of the article carrier 10 than the connection of the platform 44 to the other upstanding panel 32. Although the panel having the greatest height of connection to the platform 44 is shown as the innermost panel 42 the flap-panel 32 may also serve as the panel having the higher point of connection. The lines of connection 43, 47 between the platform 44 and the panels 32, 42 of the keel elements 40 are curved inwardly with respect to the platform 44 toward each other. Each panel 32, 42 also has a slit 49, 45 therethrough which permits a portion of the respective panel 32, 42 to be separated from the platform 44.

Stabilizing tabs 48 in the nature of feet extend from the panels 42, 32 of the keel elements 40 and lie in face contacting relationship with the base (outer base panel 20) of the erected article carrier. When the carrier 10 is loaded articles such as containers rest upon the tabs 48, thereby helping to secure the keel structure in place.

In the blank illustrated in FIG. 3, there can be more clearly seen the manner in which one of the keel panels 42 is struck from the inner bottom panel 12 and the manner in which the platform 44 is struck from the bottom panel 42 and the flap 32 which forms the other keel panel.

The keel structure of the invention provides keel elements 40 which are more resistant to impacts received by a loaded carrier.

Modifications may be made in the foregoing without departing from the scope and spirit of the claimed invention.

What is claimed is:

1. A keel structure for separating adjacent rows of articles in wraparound type article carrier comprising at least one keel element which separates one of the rows of articles from another, each keel element having spaced upstanding panels against which an article abuts, said upstanding panels spaced apart and interconnected by a platform having curved edges extending toward one another which permit adjacent portions of each of said upstanding panels to be flexed inwardly toward the other of said upstanding panels to receive a wall portion of one of the articles, and wherein a first height at which said platform is interconnected to one of said upstanding panels above a base of the article carrier is greater than a second height at which said platform is interconnected to the other of said upstanding panels above said base of the article carrier.

2. The keel structure of claim 1, wherein at least one portion of said upstanding panels adjacent respective said curved edges of said platform is separable so that said upstanding panels can be flexed more readily.

3. The keel structure of claim 1, wherein one of said upstanding panels is a single substantially continuous panel providing one end edge of a blank for forming the article carrier and another of said upstanding panels is struck from a base panel of the article carrier hinged to said one of said upstanding panels and wherein said platform is struck from said single substantially continuous panel.

4. The keel structure of claim 1, wherein said upstanding panels are struck from a base panel of the article carrier and wherein said platform is struck from one of said upstanding panels.

5. A keel structure for separating adjacent rows of articles in a wraparound type article carrier comprising at least one keel element which separates one of the rows of articles from another, each keel element having spaced upstanding panels against which an article abuts, said upstanding panels spaced apart and interconnected by a platform having curved edges extending toward one another which permit adjacent portions of each of said upstanding panels to be flexed inwardly toward the other of said upstanding panels to receive a wall portion of one of the articles, and having at least one tab interconnected with at least one of said upstanding panels disposed in face contacting relationship with a base of said article carrier, wherein one of said upstanding panels is a single substantially continuous panel providing one end edge of a blank for forming the article carrier and another of said upstanding panels is struck from a base panel of the article carrier hinged to said one of said upstanding panels and wherein said platform is struck from said single substantially continuous panel and wherein said at least one tab is struck from said single substantially continuous panel.

6. A keel structure for separating adjacent rows of articles in a wraparound type article carrier comprising at least one keel element which separates one of the rows of articles from another, each keel element having spaced upstanding panels against which an article abuts, said upstanding panels spaced apart and interconnected by a platform having curved edges extending toward one another which permit adjacent portions of each of said upstanding panels to be flexed inwardly toward the other of said upstanding panels to receive a wall portion of one of the articles, and having at least one tab interconnected with at least one of said upstanding panels disposed in face contacting relationship with a base of said article carrier, wherein said upstanding panels are struck from a base panel of the article carrier and wherein said platform and said at least one tab are struck from one of said upstanding panels.

7. A blank for an article carrier for a group of articles arranged in two rows, comprising a series of panels arranged to envelop three sides of the group of articles, end panels to cover the fourth side of the group of articles in overlapping relation with respect to one another when the carrier is formed, one of said end panels including a separating keel structure to be disposed between two rows of articles, said separating keel structure being formed from a series of panels foldably joined to a free end of said one of said end panels and comprising a first side panel, a platform panel, and a second side panel wherein a first distance between a connection of said first side panel to said platform and a connection of said first side panel to said one of said end panels is different than a second distance between a connection of said second side panel to said platform and a connection of said second side panel to said one of said end panels.

8. The blank of claim 7, said connection between said first side panel and said platform and said connection between said second side panel and said platform comprising fold lines inwardly curved toward one another.

9. The blank of claim 7, said one of said end panels further including at least one tab member connected to at least one of said first side panel and said second side panel such that said at least one tab member will lie in face contacting relation with another of said end panels when said carrier is erected from the blank.

* * * * *